US006370712B1

(12) United States Patent
Burns et al.

(10) Patent No.: US 6,370,712 B1
(45) Date of Patent: Apr. 16, 2002

(54) TOP MOUNT PLUMBING FIXTURE

(75) Inventors: Leonard J. Burns, Lorain; Nicholas A. Mascari, Newburgh Heights; Martin Zummersch, Westlake, all of OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 09/885,747

(22) Filed: Jun. 20, 2001

Related U.S. Application Data

(63) Continuation-in-part of application No. 09/746,623, filed on Dec. 22, 2000.

(51) Int. Cl.[7] ..... E03C 1/04

(52) U.S. Cl. ..... 4/675; 4/696; 137/359; 137/801; 285/64

(58) Field of Search ..... 4/675–678, 696; 137/359, 360, 801; 285/64, 208

(56) References Cited

U.S. PATENT DOCUMENTS

| | | | |
|---|---|---|---|
| 1,960,278 | A | 5/1934 | Niedecken |
| 3,010,474 | A | 11/1961 | Moen |
| 3,785,396 | A | 1/1974 | Morris et al. |
| 3,790,966 | A | 2/1974 | Keane |
| 4,005,883 | A | 2/1977 | Guest |
| 4,281,857 | A | 8/1981 | Randall |
| 4,356,574 | A | 11/1982 | Johnson |
| 4,553,277 | A | 11/1985 | Duncan |
| 4,654,900 | A | 4/1987 | McGhee |
| 4,671,316 | A | 6/1987 | Botnick |
| 4,760,861 | A | 8/1988 | Botnick |
| 4,762,143 | A | 8/1988 | Botnick |
| 4,848,395 | A | 7/1989 | Krippendorf |
| 4,852,192 | A | 8/1989 | Viegener |
| 4,967,784 | A | 11/1990 | Barhydt, Sr. et al. |
| 4,998,555 | A | 3/1991 | Barhydt, Sr. et al. |
| 5,010,922 | A | 4/1991 | Agresta |
| 5,127,427 | A | 7/1992 | Kajpust et al. |
| 5,213,268 | A | 5/1993 | Gnauert et al. |
| 5,232,008 | A | 8/1993 | Jeffress et al. |

(List continued on next page.)

FOREIGN PATENT DOCUMENTS

| | | |
|---|---|---|
| EP | 0 213 656 | 3/1987 |

*Primary Examiner*—Gregory L. Huson
*Assistant Examiner*—Tuan Nguyen
(74) *Attorney, Agent, or Firm*—Cook, Alex, McFarron, Manzo, Cummings & Mehler, Ltd.

(57) ABSTRACT

A plumbing fixture adapted to be installed from the top side of a sink deck through a sink deck opening includes a housing having a body portion which is adapted to extend through the sink deck opening and below the sink deck when mounted. The housing has a shoulder which is adapted to seat on the sink deck when mounted. There is a collar slidably movable on the body portion and of a size to pass through the sink deck opening. A threaded bore is in the collar and an unthreaded bore is in the housing shoulder, and a threaded member extends through these bores, with rotation of the threaded member from above the sink deck moving the collar axially along the housing body portion. The housing body portion has a recessed area thereon to accommodate inward movement of a pair of outwardly-biased yielding members, such as button-shaped projections, which are associated with the collar and extend outwardly therefrom such that when so extended the collar will not pass through the sink deck opening. The fixture is mounted to the sink deck by first compressing the outwardly-extending button-shaped projections to pass the body portion and collar through the sink deck opening from above the sink deck until the shoulder portion is seated on the sink deck and the button-shaped projections have extended after passing through the sink deck opening. The threaded member is then rotated until the collar has moved axially along the body portion and is in contact with the underside of the sink deck.

14 Claims, 2 Drawing Sheets

U.S. PATENT DOCUMENTS 5,361,431 A 11/1994 Freier et al.
5,388,287 A 2/1995 Tischler et al.
5,465,749 A 11/1995 Sauter et al.
5,515,882 A 5/1996 Hennis
5,558,128 A 9/1996 Pawelzik et al.
5,584,513 A 12/1996 Sweeny et al.
5,660,203 A 8/1997 Gnauert et al.
5,822,811 A 10/1998 Ko
5,865,211 A 2/1999 Thomas
5,946,746 A 9/1999 Bloom
5,983,917 A 11/1999 Thomas
6,014,985 A 1/2000 Warshawsky

TOP MOUNT PLUMBING FIXTURE

This application is a CIP of Ser. No. 09/746,623 filed Dec. 22, 2000.

THE FIELD OF THE INVENTION

The present invention relates to plumbing fixtures and particularly to such a fixture which may be mounted completely from above a sink deck. In the past, it has been conventional for the plumbing fixture to be seated upon the sink deck and then the installer, of necessity, must go underneath the sink deck to a small, cramped area to fasten the plumbing fixture onto the sink deck. The present invention invention removes the necessity for the installer to go beneath the sink deck for any purpose other than to attach the water connections or hoses between one or more of the plumbing fixtures.

The plumbing fixture of the present invention essentially provides a housing in which may be installed various types of plumbing devices such as a water control valve, the nipple for a spout, or the connection for a kitchen deck side spray. The plumbing fixture is essentially the same, regardless of the type of water control plumbing device which will be mounted in it.

The plumbing fixture includes a housing which has a body portion adapted to extend through a sink deck opening. There is a shoulder on the housing which seats on top of the sink deck around the sink deck opening. There is a collar slidable on the body portion and of a size to extend through the sink deck opening. The collar has a threaded bore and the shoulder has an unthreaded bore and there is a threaded member such as a bolt which extends through these bores, with rotation of the bolt, from above the sink deck, axially moving the collar along the body portion of the housing. There is a sleeve within the collar which has a pair of oppositely-positioned button-shaped projections which extend through openings in the collar. When the projections are compressed, they allow the collar to pass through the sink deck opening, and when allowed to expand, prevent the collar from moving through the sink deck opening. Thus, these elements are compressed when the plumbing fixture is mounted to the sink deck opening, allowed to expand once they have passed through the sink deck opening, after which the bolt is turned to move the collar and the extended projections snugly up against the bottom of the sink deck to complete installation.

The body portion of the housing has a pair of oppositely-positioned recessed areas to accommodate inward movement of the button-shaped projections. There are cam-shaped ramps which assist the projections in moving to their outwardly-extended position, with these ramps bordering on and forming a transition between the recessed areas and the cylindrical portion of the housing body portion.

SUMMARY OF THE INVENTION

This is a continuation-in-part of co-pending application Ser. No. 09/746,623 filed Dec. 22, 2000.

The present invention relates to a plumbing fixture which may be installed from above the sink deck.

A primary purpose of the invention is to provide a plumbing fixture which may be used to house various types of water control plumbing devices, and which may be installed, except for hose connections, from above the sink deck.

Another purpose of the invention is to provide a plumbing fixture which has outwardly-biased button-shaped projections, which when extended, prevent the housing of the plumbing fixture from passing through a sink deck opening, but when compressed, will permit such passage.

Another purpose of the invention is to provide a plumbing fixture as described in which the housing of the fixture mounts a slidable collar, within which is positioned a sleeve having outwardly-directed button-shaped projections, biased to extend radially beyond the extent of the collar.

Another purpose is to provide a simply constructed reliable plumbing fixture as described, in which the housing has recessed areas to accommodate inward movement of the button-shaped projections and cams to assist the projections in moving outwardly from the confines of the collar.

Another purpose of the invention is to provide a plumbing fixture as described in which the housing has an axial projection to provide an anti-rotation key and to accommodate a portion of the water supply connections to the housing.

Other purposes will appear in the ensuing specification, drawings and claims.

BRIEF DESCRIPTION OF THE DRAWINGS

The invention is illustrated diagrammatically in the following drawings wherein.

DESCRIPTION OF THE PREFERRED EMBODIMENT

Figure 1:
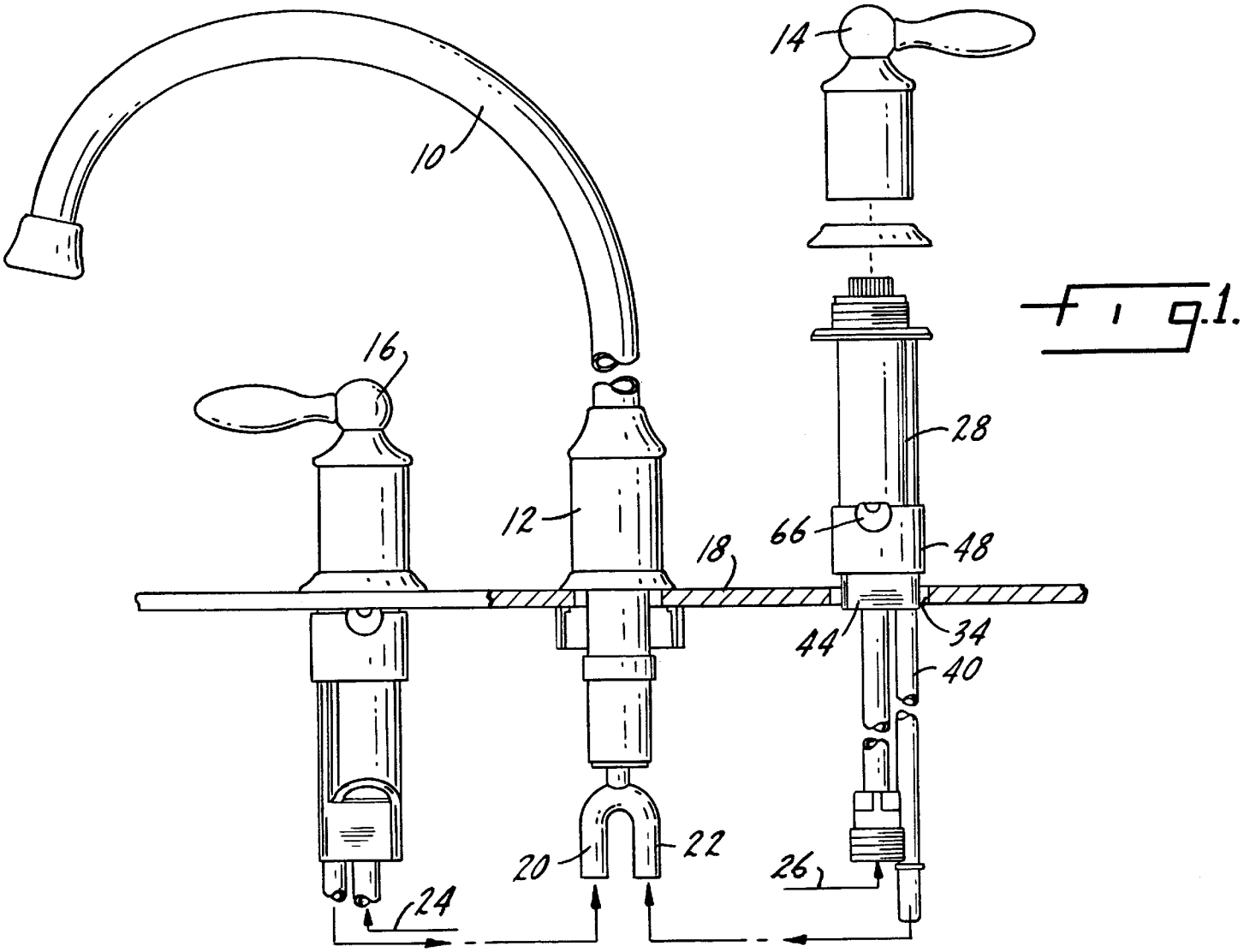
FIG. 1 is a front view, in part exploded, showing the plumbing fixture of the present invention as a part of a kitchen faucet installation having several water control plumbing devices.

FIG. 1 illustrates a kitchen faucet suite including a centrally disposed spout 10 extending outwardly from a spout nipple housing 12. On each side of the spout 10 there is a faucet control handle indicated at 14 on the right and at 16 on the left, with the right side faucet handle being shown in an exploded view. Although not shown, there may be a kitchen deck side spray associated with the kitchen suite. The plumbing fixture of the present invention may be used to mount any one of the above-described water control plumbing devices and these devices may be mounted from above the sink deck, with the exception of the hose connections between the various fixtures.

As an example, the spout nipple 12 shows, beneath the sink deck 18, a pair of input conduits 20 and 22 to connect the hot and cold water supplies from the handles 14 and 16. Similarly, there are hose connections to each of the valves 14 and 16 in the form of an input water connection 24 for the valve 16 and an input water connection 26 for the valve 14. If a side spray were to be used in the kitchen suite, there would be a connection, by hose, from the spout nipple 12 to the side spray.

The present invention is specifically concerned with the housing for the plumbing fixture and is shown in an exploded form at the right side of FIG. 1. The present application is a continuation-in-part of Ser. No. 09/746,623, filed Dec. 22, 2000, which shows similar forms of plumbing fixtures and the present invention is a continuation of the development efforts by the assignee of the present application, Moen Incorporated, of North Olmsted, Ohio, to provide plumbing fixtures which are essentially completely installed from above the sink deck.

The plumbing fixture as illustrated in FIGS. 2 through 11 includes a housing indicated generally at 28 which has an upper threaded area 30 adjacent an outwardly-extending flange or shoulder 32. The shoulder 32 will rest on the surface of the sink deck and the housing 28 will extend through opening 34 in the sink deck, as illustrated in the exploded portion at the right side of FIG. 1. Within the housing 28 there may be positioned a valve cartridge which may be one of several types manufactured by Moen Incorporated and which provide for control of water flow to the spout 10.

Figure 5:
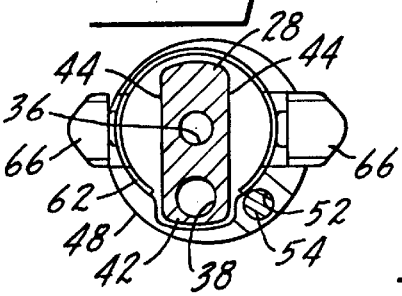
FIG. 5 is a section along plane 5—5 of FIG. 4.

The housing 28 has an internal cavity 34 within which the valve cartridge will be positioned and there is a water inlet connection 36 which is connected to the input connection 26. There is also a water outlet passage 38 which connects to the conduit 40 which in turn carries water to the spout nipple 12. The passage 38, as particularly shown in FIG. 5, is in an axially-extending rib or projection 42 which extends along the length of the housing 28 and not only provides for location of the passage 38, but also functions as a key to prevent rotation of the collar to be described during mounting and assembly of the housing on the sink deck.

Figure 4:
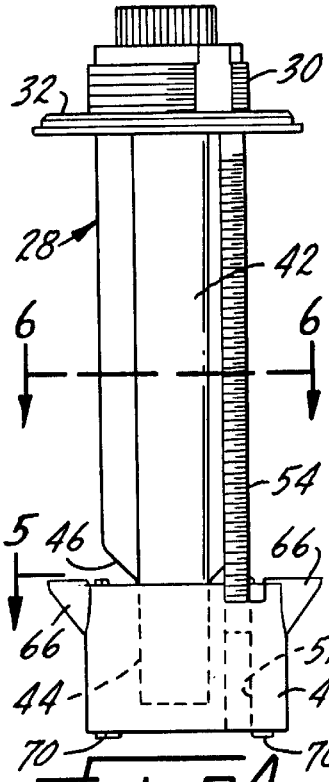
FIG. 4 is a side view of the plumbing fixture as viewed from the side of the illustration in FIG. 3.

The exterior of the housing 28, which in the preferred form of the invention is a forging, rather than a conventional casting, there are a pair of inwardly-directed recesses, illustrated in FIG. 4 at 44, and located at the lower end or bottom of the housing 28. Adjacent each of the recesses 44 there is a ramp 46 which functions as a cam during assembly of the housing to the sink deck, as will be described hereinafter.

Figure 10:
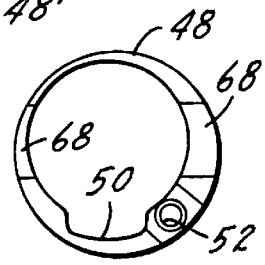
FIG. 10 is a top view of the collar.

Slidably mounted on the housing 28 is a collar 48 which has an internal cross sectional area, indicated in FIG. 10, which essentially matches that of the exterior of the housing 28. This provides for sliding movement of the collar on the housing, but prevents rotation of the collar relative to the housing because of the interlock between the key 42 and the recess 50 on the interior of the collar 48.

Figure 2:
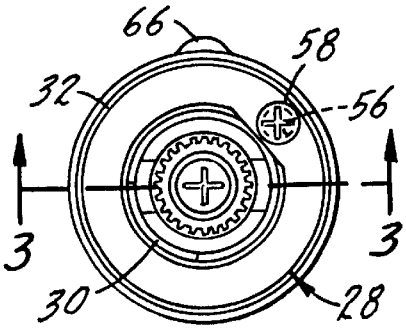
FIG. 2 is a top view of the plumbing fixture of FIG. 1.

The collar 48 has a threaded bore 52 which receives a threaded bolt 54, the upper end of which extends through an opening 56 in the flange or shoulder 32. The head 58 of the bolt 54 is shown in FIG. 2.

Figure 7:
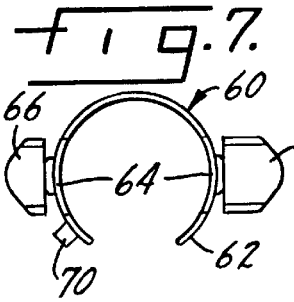
FIG. 7 is a top view of the sleeve which is located within the collar.
Figure 8:
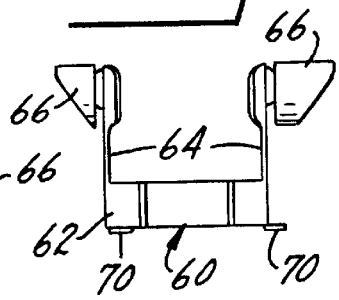
FIG. 8 is a side view of the sleeve.
Figure 3:
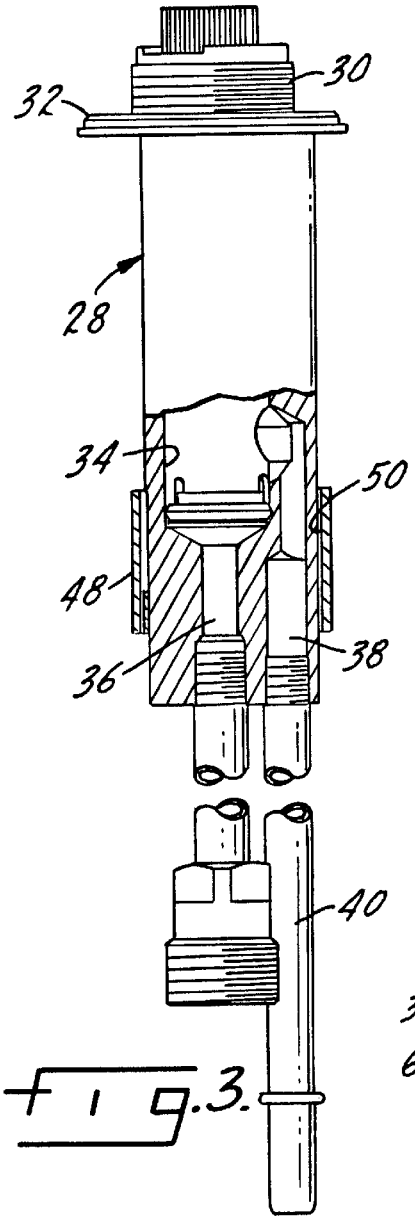
FIG. 3 is a partial section along plane 3—3 of FIG. 2.
Figure 9:
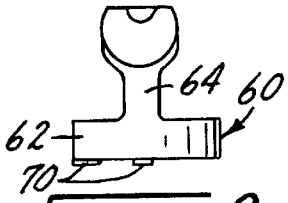
FIG. 9 is a further side view of the sleeve illustrating the shape of the button-shaped projections.
Figure 6:
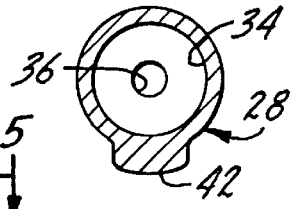
FIG. 6 is a section along plane 6—6 of FIG. 4.
Figure 11:
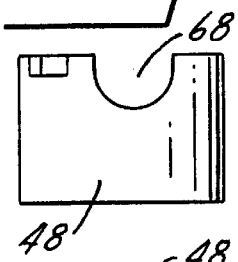
FIG. 11 is a side view of the collar.

Positioned inside of the collar 48 is a sleeve 60 illustrated in FIGS. 7–9. The sleeve has a discontinuous arcuate body 62 which is formed of a flexible or spring-like material. The sleeve has a pair of upwardly extending arms 64, each of which mounts a button-shaped projection 66 at the upper end thereof. When the sleeve is positioned within the collar 48, the projections will be biased by the flexibility of the sleeve 60 to extend outwardly through arcuate openings 68 in the wall of the collar. Thus, in the normal state, the collar and the associated sleeve will be as illustrated in FIGS. 4 and 5, with the projections extending out through the openings in the collar. The sleeve 60 has stop projections 70 which fit against the underside of the collar in order to hold the sleeve in place within the collar 48.

When the plumbing fixture is to be assembled to the sink deck, the collar 48 will be adjacent the lower end of the housing 28, as illustrated in FIG. 4. The button-like projections 66 will extend outwardly from the collar. As the housing is passed through the opening 34 in the sink deck, the sides of the opening will force the projections 66 inward, as permitted by the flexibility of the sleeve and the recesses 44. The projections will pass inward a distance sufficient for the collar to pass through the opening in the sink deck. The housing may then be pushed all the way through the opening in the sink deck until the flange 32 is seated upon the deck. The bolt 54 is then turned which will cause the collar to move upward toward the bottom of the sink deck. The cam surfaces 46 will insure that the projections are pushed outwardly as the collar slides upwardly upon the housing 28. Upward movement of collar will continue until its upper edge and the buttons are snug against the underside of the sink deck as shown at the left side of FIG. 1. This completes installation of the plumbing fixture. The water control device may then be suitably mounted therein.

Of importance in the invention is the configuration of the housing 28, which as indicated earlier, is preferably a forging and which has on its exterior a rib which functions not only as a key to prevent rotation of the collar, but also provides entrance for the water passage 38. There are a pair of spring-like buttons mounted to a sleeve which is positioned within the collar and the buttons will provide a means for preventing removal of the housing from the sink deck after it has been fully assembled and attached. The key prevents rotation of the collar relative to the housing when the bolt 54 is turned and limits the collar to slidable movement. The ramps 46 on the side of the housing insure that the buttons will be pushed outwardly as the collar moves up and the recess directly below the ramps provides for an area into which the buttons can move when the housing is inserted through the opening in the sink deck.

Whereas the preferred form of the invention has been shown and described herein, it should be realized that there may be many modifications, substitutions and alterations thereto.

The embodiments of the invention in which an exclusive property or privilege is claimed are as follows:

1. A plumbing fixture adapted to be installed from the top side of a sink deck through a sink deck opening, said fixture including a housing having a body portion which is adapted to extend through the sink deck opening and extend below the sink deck when mounted, and a shoulder portion on said housing which is adapted to seat on the sink deck when mounted, a collar slidably movable on said body portion and of a size to pass through the sink deck opening, a threaded bore in said collar, an unthreaded bore in said housing shoulder portion, a threaded member extending through said unthreaded and threaded bores, with rotation of said threaded member from above the sink deck moving said collar axially along said housing body portion, outwardly-biased yielding means slidably movable on said body portion and being positioned within said collar and extending outwardly therefrom, such that when so extended the collar will not pass through the sink deck opening, said housing body portion having a recessed area thereon to accommodate inward movement of said outwardly-biased yielding means, whereby the plumbing fixture is adapted to be mounted to the sink deck by first compressing the yielding means into the recessed area of the housing body portion to pass the body portion and collar through the sink deck opening from above the sink deck until the shoulder portion is seated on the sink deck and the yielding means has extended after passing through the sink deck opening, the threaded member is then rotated until the collar has moved axially along the body portion and is in contact with an underside of the sink deck.

2. The plumbing fixture of claim 1 wherein said yielding means includes at least one outwardly-extending button-shaped member, extending from within said collar, outwardly through a slot in said collar, with said button-shaped member, when so extended, preventing the passage of said collar through the sink deck opening.

3. The plumbing fixture of claim 2 wherein there are a pair of diametrically opposed outwardly-extending button-shaped members, extending from within said collar, outwardly through slots in said collar, and said housing body portion has a pair of recessed areas, on opposite sides thereof, to accommodate inward movement of said button-shaped members.

4. The plumbing fixture of claim 3 wherein said button-shaped members are part of a sleeve located within said collar.

5. The plumbing fixture of claim 4 further including cooperating locating means on said collar and sleeve.

6. The plumbing fixture of claim 4 wherein said sleeve is discontinuous.

7. The plumbing fixture of claim 1 wherein said recessed area is at a lower end of said housing body portion, and a cam ramp extending between said recessed area and non-recessed portions of said housing body portion.

8. The plumbing fixture of claim 7 wherein there are a pair of diametrically opposed recessed areas on said housing body portion and a cam ramp extending between each of said recessed areas and non-recessed portions of said housing body portion.

9. The plumbing fixture of claim 1 wherein said housing body portion includes an axially-extending projection preventing rotation between said housing body portion and said collar.

10. The plumbing fixture of claim 9 wherein said axially-extending projection includes, through a portion thereof, an axially-extending waterway bore.

11. A plumbing fixture adapted to be installed from the top side of a sink deck through a sink deck opening, said fixture including a housing having a body portion which is adapted to extend through the sink deck opening and extend below the sink deck when mounted, and a shoulder portion on said housing which is adapted to seat on the sink deck when mounted, a collar slidably movable on said body portion and of a size to pass through the sink deck opening, a threaded bore in said collar, an unthreaded bore in said housing shoulder portion, a threaded member extending through said unthreaded and threaded bores, with rotation of said threaded member from above the sink deck moving said collar axially along said housing body portion, a sleeve positioned within said collar, a pair of outwardly-extending projections on said sleeve and outwardly-biased to extend through openings in said collar, such that said projections when so extended through the collar will not pass through the sink deck opening, whereby the plumbing fixture is adapted to be mounted to the sink deck by first compressing the outwardly-extending projections to pass the body portion and collar through the sink deck opening from above the sink deck until the shoulder portion is seated on the sink deck and the projections have extended, after passing through the sink deck opening, the threaded member then being rotated until the collar has moved axially along the housing body portion and is in contact with an underside of the sink deck.

12. The plumbing fixture of claim 11 wherein said projections have a button-shaped configuration and each is mounted on an arm which is integral with said sleeve.

13. The plumbing fixture of claim 12 wherein said housing body portion has recessed means thereon to accommodate inward movement of said button-shaped projections.

14. The plumbing fixture of claim 11 wherein said plumbing fixture body member is formed and adapted to receive a water control valve.

* * * * *